US010207318B2

(12) United States Patent
Lehman et al.

(10) Patent No.: US 10,207,318 B2
(45) Date of Patent: Feb. 19, 2019

(54) ELECTROMAGNETIC BRAKE SYSTEM AND METHOD OF CONTROLLING MOLTEN METAL FLOW IN A METAL-MAKING PROCESS

(71) Applicant: ABB Schweiz AG, Baden (CH)

(72) Inventors: Anders Lehman, Bromma (SE); Jan-Erik Eriksson, Västrås (SE); Martin Sedén, Västerås (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/514,888

(22) PCT Filed: Nov. 20, 2014

(86) PCT No.: PCT/EP2014/075167

§ 371 (c)(1),
(2) Date: Mar. 28, 2017

(87) PCT Pub. No.: WO2016/078718

PCT Pub. Date: May 26, 2016

(65) Prior Publication Data

US 2017/0216909 A1 Aug. 3, 2017

(51) Int. Cl.
*B22D 11/11* (2006.01)
*B22D 11/04* (2006.01)
(Continued)

(52) U.S. Cl.
CPC ..... *B22D 11/115* (2013.01); *B22D 11/04* (2013.01); *B22D 11/16* (2013.01); *B22D 27/02* (2013.01);
(Continued)

(58) Field of Classification Search
CPC ..... B22D 11/11; B22D 11/115; B22D 11/16
See application file for complete search history.

(56) References Cited

U.S. PATENT DOCUMENTS 4,867,786 A * 9/1989 Saeki ..... B22D 11/115 266/234
6,164,365 A 12/2000 Kunstreich et al.
(Continued)

FOREIGN PATENT DOCUMENTS

EP 1172158 A1 1/2002
EP 1623777 A1 2/2006
(Continued)

OTHER PUBLICATIONS

Kollberg et al, Speed limit! Direct control of electromagnetic braking for faster thick-slab casting, ABB Review, published Feb. 19, 2004.*
(Continued)

*Primary Examiner* — Kevin E Yoon
*Assistant Examiner* — Jacky Yuen
(74) *Attorney, Agent, or Firm* — Whitmyer IP Group LLC

(57) ABSTRACT

A method of controlling molten metal flow and an electromagnetic brake system for a metal-making process, including: a first magnetic core arrangement having a first and second long sides with $N_c$ teeth, and arranged to be mounted to opposite longitudinal sides of an upper portion of a mould, a first set of coils, each being wound around a respective tooth of the first magnetic core arrangement, and $N_p$ power converters, with $N_p$ being an integer that is at least two and $N_c$ is an integer that is at least four and evenly divisible with $N_p$, wherein each power converter is configured to feed a DC current to its respective group of $2N_c/N_p$ series-connected coils.

14 Claims, 4 Drawing Sheets

(51) Int. Cl.

| | |
|---|---|
| ***B22D 11/16*** | (2006.01) |
| ***B22D 11/115*** | (2006.01) |
| ***B22D 27/02*** | (2006.01) |
| *H01F 3/00* | (2006.01) |
| *H01F 7/20* | (2006.01) |

(52) U.S. Cl.
CPC ..... *B22D 11/11* (2013.01); *H01F 3/00* (2013.01); *H01F 7/20* (2013.01)

(56) References Cited

U.S. PATENT DOCUMENTS

| | | | | |
|---|---|---|---|---|
| 8,167,024 | B2 * | 5/2012 | Kunstreich | B22D 11/115 164/468 |
| 8,596,334 | B2 | 12/2013 | Miki | |
| 2004/0182539 | A1 * | 9/2004 | Yamane | B22D 11/115 164/466 |
| 2005/0039876 | A1 * | 2/2005 | Eriksson | B22D 11/115 164/466 |
| 2005/0045303 | A1 * | 3/2005 | Itoyama | B22D 11/00 164/453 |
| 2007/0272388 | A1 * | 11/2007 | Miki | B22D 11/115 164/466 |
| 2013/0133852 | A1 | 5/2013 | Guastini et al. | |

FOREIGN PATENT DOCUMENTS

| | | | | |
|---|---|---|---|---|
| EP | 2218528 | A1 | 8/2010 | |
| JP | 05154623 | A * | 6/1993 | |
| JP | 06182518 | A | 7/1994 | |
| JP | 09262650 | A | 10/1997 | |
| JP | 10305353 | A | 11/1998 | |
| JP | 10328790 | A | 12/1998 | |
| JP | 2004322179 | A | 11/2004 | |
| KR | 20140095100 | A | 7/2014 | |
| WO | 03041893 | A1 | 5/2003 | |
| WO | 2008004969 | A1 | 1/2008 | |
| WO | 2013069121 | A1 | 5/2013 | |
| WO | 2013091701 | A1 | 6/2013 | |
| WO | WO 2013091701 | A1 * | 6/2013 | B22D 11/115 |

OTHER PUBLICATIONS

Kollberg, Sten G. et al: "Improving Quality of Flat Rolled Products Using Electromagnetic Brake (EMBR) in Continuous Casting" Aise Steel Technology, Aise, Pittsburg, Pennsylvania, vol. 73, No. 7. Jul. 1, 1996 6 Pages.

Hackl Helmut et al: "Second Generation EMBR Boosts Slab Casting Speed and Quality" Steel Times International, DMG World Media, Lewes, United Kingdom, vol. 18, No. 6 Nov. 1, 1994 2 Pages.

International Search Report & Written Opinion Application No. PCT/EP2014/075167 Completed: Aug. 5, 2015; dated Aug. 20, 2015 12 Pages.

International Preliminary Report on Patentability Application No. PCT/EP2014/075167 Completed: May 23, 2017, 7 pages.

* cited by examiner

ELECTROMAGNETIC BRAKE SYSTEM AND METHOD OF CONTROLLING MOLTEN METAL FLOW IN A METAL-MAKING PROCESS

TECHNICAL FIELD

The present disclosure generally relates to metal making. In particular, it relates to an electromagnetic brake system in a metal-making process and to a method of controlling molten metal flow in a metal-making process.

BACKGROUND

In metal-making, for example steelmaking, metal can be produced from iron ore in a blast-furnace and converter or as scrap metal and/or direct reduced iron, melted in an electric arc furnace (EAF). The molten metal may be tapped from the EAF to one or more metallurgical vessels, for example to a ladle and further to a tundish. The molten metal may in this manner undergo suitable treatment, both in respect of obtaining the correct temperature for moulding, and for alloying and/or degassing, prior to the moulding process.

When the molten metal has been treated in the above-described manner, it may be discharged through a submerged entry nozzle (SEN) into a mould, typically an open-base mould. The molten metal partially solidifies in the mould. The solidified metal that exits the base of the mould is further cooled as it passed between a plurality of rollers in a spray-chamber.

As the molten metal is discharged into the mould, undesired turbulent molten metal flow around the meniscus may occur. This flow may lead to slag entrainment due to excessive surface velocity or to surface defects due to surface stagnation or level fluctuations.

In order to control the fluid flow, the mould may be provided with an electromagnetic braker (EMBr). The EMBr comprises a magnetic core arrangement which has a number or teeth, and which magnetic core arrangement extends along the long sides of the mould. The EMBr is beneficially arranged in level with the SEN, i.e. at the upper portion of the mould. A respective coil, sometimes referred to as a partial coil, is wound around each tooth. These coils may be connected to a drive that is arranged to feed the coils with a direct (DC) current. A static magnetic field is thereby created in the molten metal. The static magnetic field acts as a brake for the molten metal. The flow at the upper regions, close to the meniscus of the molten metal, may thereby be controlled. As a result, better surface conditions may be obtained.

The utilisation of an EMBr does however not provide optimal fluid flow control of the molten metal, along the entire cross section of the molten metal, near the meniscus.

SUMMARY

In view of the above, an object of the present disclosure is to provide an electromagnetic brake system and a method of controlling molten metal flow in a metal-making process which solve or at least mitigate the problems of the prior art.

Hence, according to a first aspect of the present disclosure there is provided an electromagnetic brake system for a metal-making process, wherein the electromagnetic brake system comprises: a first magnetic core arrangement having a first long side and a second long side, which first long side has $N_c$ teeth and which second long side has $N_c$ teeth, wherein the first long side and the second long side are arranged to be mounted to opposite longitudinal sides of an upper portion of a mould, a first set of coils, wherein the first set of coils comprises $2N_c$ coils, each coil being wound around a respective tooth of the first magnetic core arrangement, and $N_p$ power converters, with $N_p$ being an integer that is at least two and $N_c$ is an integer that is at least four and evenly divisible with $N_p$, wherein each power converter is connected to a respective group of $2N_c/N_p$ series-connected coils of the first set of coils, and wherein each of the $N_p$ power converters is configured to feed a DC current to its respective group of $2N_c/N_p$ series-connected coils.

An effect which may be obtainable thereby is that further control possibilities, in regards of molten metal flow braking, may be provided. Better flow control can therefore be achieved, which is reflected in higher quality of the metal end product thus obtained.

This effect may be obtained because $N_p$ DC currents each with an individually selected amplitude and polarity may be applied to the groups of coils. In particular, each group of $2N_c/N_p$ series-connected coils is fed with DC current from only one of the $N_p$ power converters, with each power converter being individually controllable. The groups of $2N_c/N_p$ series-connected coils may be arranged in a plurality of configurations along the first long side and the second long side of the first magnetic core, and thus along the longitudinal direction of the mould to which the electromagnetic brake system may be mounted. This results in the possibility of a number of different static magnetic field distributions along the longitudinal direction. The static magnetic field amplitude may hence be controlled locally along an axis parallel with the first long side and the second long side of the first magnetic core. Compared to the prior art, the static magnetic field amplitude may be controlled to be inhomogeneous in the longitudinal direction.

According to one embodiment each power converter is individually controllable thereby enabling a controllable homogeneous or inhomogeneous magnetic field distribution along the first long side and the second long side of the first magnetic core arrangement.

According to one embodiment at least two coils of each group are wound around teeth of either the first long side or the second long side of the first magnetic core arrangement.

According to one embodiment, between any of two subsequently arranged coils of a group of coils, along either the first long side or the second long side, is a coil of another group of coils.

According to one embodiment each of the $N_p$ power converters is configured to provide an AC current to its respective group of $2N_c/N_p$ series-connected coils to thereby enable electromagnetic stirring.

According to one embodiment each power converter is a drive.

One embodiment comprises a second magnetic core arrangement having a first long side and a second long side, which first long side and the second long side comprises a plurality of teeth, and a second set of coils, each coil of the second set of coils being wound around a respective tooth, wherein the first long side and the second long side are arranged to be mounted to opposite longitudinal sides of a lower portion of the mould.

One embodiment comprises a power converter configured to provide DC current to the second set of coils.

According to a second aspect of the present disclosure there is provided a method of controlling molten metal flow in a metal-making process, by means of an electromagnetic brake system comprising a first magnetic core arrangement having a first long side and a second long side, which first long side has $N_c$ teeth and which second long side has $N_c$ teeth, wherein the first long side and the second long side are mounted to opposite longitudinal sides of an upper portion of a mould, in level with a submerged entry nozzle, SEN, a first set of coils, wherein the first set of coils comprises $2N_c$ coils, each coil being wound around a respective tooth of the first magnetic core arrangement, and $N_p$ power converters, with $N_p$ being an integer that is at least two and $N_c$ is an integer that is at least four and evenly divisible with $N_p$, wherein each power converter is connected to a respective group of $2N_c/N_p$ series-connected coils of the first set of coils, and wherein each of the $N_p$ power converters is arranged to feed a DC current to its respective group of $2N_c/N_p$ series-connected coils, wherein the method comprises controlling the $N_p$ power converters to obtain braking of the molten metal in the upper portion of the mould.

One embodiment comprises controlling each power converter individually to obtain either a homogeneous or inhomogeneous magnetic field distribution along the first long side and the second long side of the first magnetic core arrangement.

According to one embodiment at least two coils of each group are wound around teeth of either the first long side or the second long side of the first magnetic core arrangement.

According to one embodiment, between any of two subsequently arranged coils of a group of coils, along either the first long side or the second long side, is a coil of another group of coils.

According to one embodiment, each of the $N_p$ power converters is configured to provide an AC current to its respective group of $2N_c/N_p$ series-connected coils to thereby enable electromagnetic stirring.

According to one embodiment each power converter is a drive.

According to one embodiment the electromagnetic brake comprises a second magnetic core arrangement having a first long side and a second long side, which first long side and the second long side comprises a plurality of teeth, and a second set of coils, each coil of the second set of coils being wound around a respective tooth, wherein the first long side and the second long side are arranged to be mounted to opposite longitudinal sides of a lower portion of the mould.

One embodiment comprises a power converter configured to provide DC current to the second set of coils, wherein the method further comprises controlling the power converter.

Generally, all terms used in the claims are to be interpreted according to their ordinary meaning in the technical field, unless explicitly defined otherwise herein. All references to "a/an/the element, apparatus, component, means, etc. are to be interpreted openly as referring to at least one instance of the element, apparatus, component, means, etc., unless explicitly stated otherwise. Moreover, the steps of the method need not necessarily have to be carried out in the indicated order unless explicitly stated.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

The electromagnetic braker systems presented herein may be utilised in metal-making, more specifically in casting. Examples of metal-making processes are steelmaking and aluminium-making. The electromagnetic braker system may beneficially be utilised in for example a continuous casting process.

Figure 1:
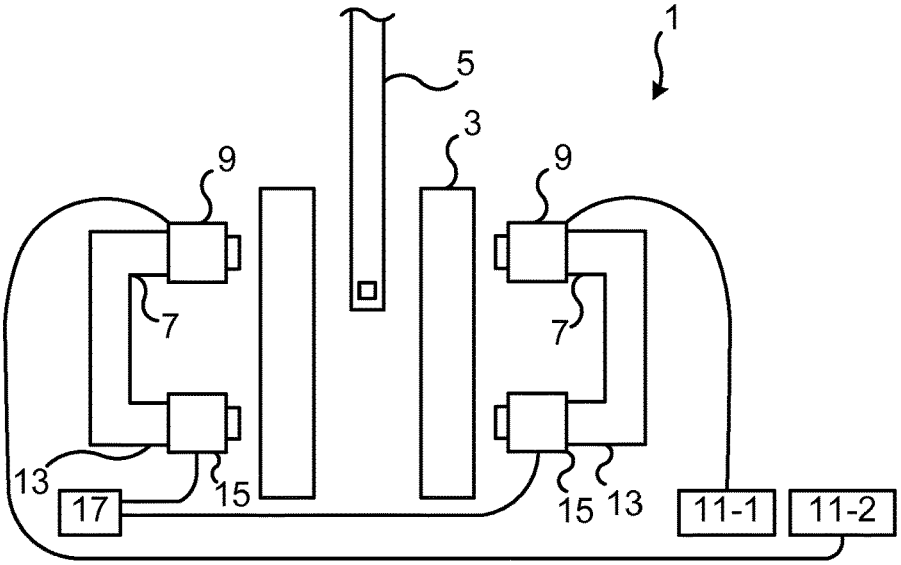
FIG. 1 schematically shows a side view of an electromagnetic brake system mounted to a mould.

An example of an electromagnetic braker system 1 is depicted in FIG. 1. In this example, the electromagnetic braker system 1 is mounted to a mould 3. Furthermore, in order to facilitate the understanding of approximately where the electromagnetic braker system 1 may be mounted to the mould 3, an SEN 5 extending into the mould 3 is shown.

The electromagnetic braker system 1 comprises a first magnetic core arrangement 7 and a first set of coils comprising a plurality of coils 9. Each coil 9 is arranged around a respective tooth of the first magnetic core arrangement 7. The coils 9 are arranged in groups of coils. The coils in each group are series-connected. The electromagnetic braker system 1 comprises at least two power converters 11-1 to 11-2 configured to feed DC current to the coils 9 of the groups of coils. Each group of coils is fed by a respective power converter 11-1, 11-2.

The first magnetic core arrangement 7 is arranged to be mounted to an upper portion of the mould 3. In particular, the first magnetic core arrangement 7 is arranged to be mounted in level with a SEN 5 that is arranged in the mould 3.

The power converters 11-1, 11-2 may according to one variation additionally be configured to feed an AC current to the coils 9. The electromagnetic braker system 1 may thereby also act as an electromagnetic stirrer.

The present disclosure primarily concerns the configuration of the first magnetic core arrangement 7, its associated coils 9, and the power converters 11-1, 11-2 that are configured to feed a DC current to the respective groups of coils.

Optionally, the electromagnetic braker system 1 may further comprise a second magnetic core arrangement 13 and a second set of coils comprising a plurality of coils 15. Each 15 is arranged around a respective tooth of the second magnetic core arrangement 13. The electromagnetic braker system 1 may in this case comprise an additional power converter 17 arranged to feed a DC current to the coils 15 of the second set of coils.

In the example shown in FIG. 1, the first magnetic core arrangement 7 and the second magnetic core arrangement 13 are integrated. Alternatively, the first magnetic core arrangement and the second magnetic core arrangement may be separate structures.

Figure 2:
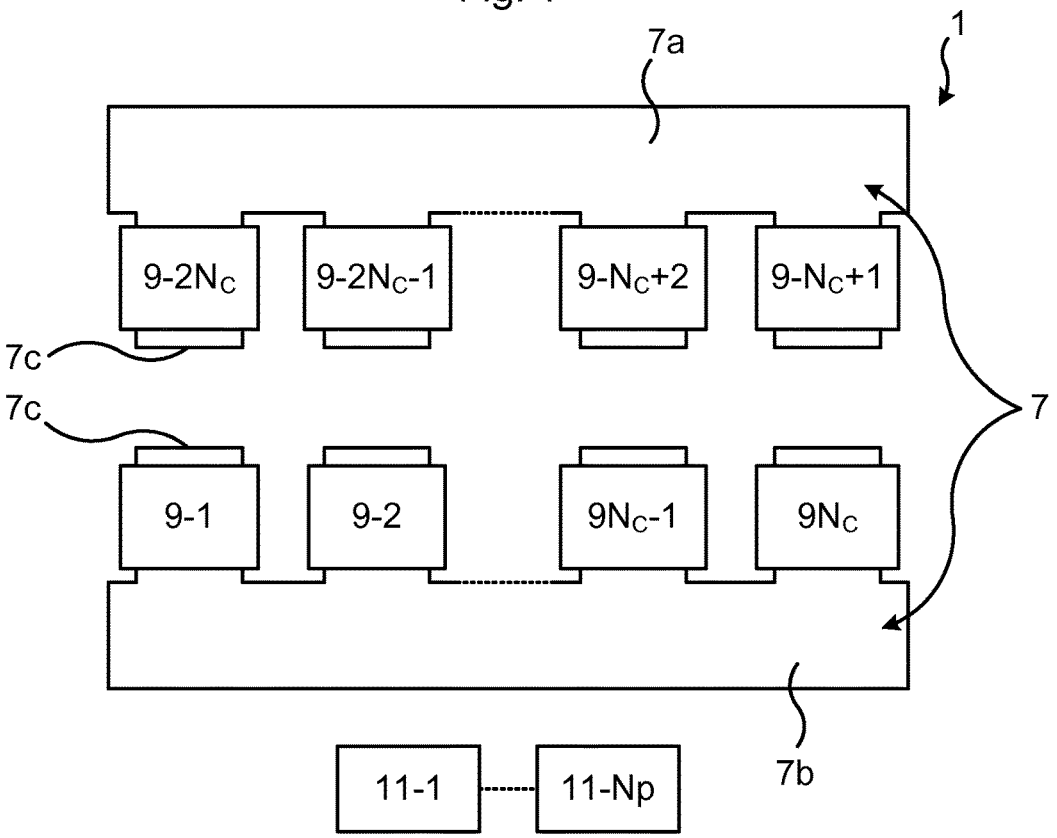
FIG. 2 schematically shows a top view of an electromagnetic brake system.

The electromagnetic braker system 1 will now be described in more detail with reference to FIG. 2. The first magnetic core arrangement 7 has a first long side 7*a* and a second long side 7*b*. The first long side 7*a* and the second long side 7*b* may be separate structures, as exemplified in FIG. 2. Alternatively, the first long side and the second long side may be integrated.

The first long side 7*a* has $N_c$ teeth 7*c*, where $N_c$ is an integer that is at least four. The second long side 7*b* has a $N_c$ teeth 7*c*, where $N_c$ is an integer that is at least four. The first set of coils comprises $2N_c$ coils 9-1, . . . , 9-2$N_c$. Each coil 9-1, . . . , 9-2$N_c$ is arranged around a respective tooth 7*c* of the first magnetic core arrangement 7.

The electromagnetic brake system 1 comprises $N_p$ power converters 11-1, . . . , 11-$N_p$, $N_p$ being an integer that is at least two and $N_c$ being an integer that is at least four and evenly divisible with $N_p$. Each power converter 11-1, . . . , 11-$N_p$ is individually controllable, thereby enabling a controllable homogeneous or inhomogeneous magnetic field distribution along the first long side 7*a* and the second long side 7*b* of the first magnetic core 7. Each power converter is a current source, for example a drive, such as ABB's DCS 600 MultiDrive.

Figure 7:
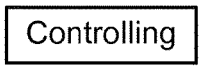
FIG. 7 shows a flowchart of a method of controlling molten metal flow in a metal-making process.

Molten metal flow in a metal-making process is controllable by means of the electromagnetic brake system 1 by controlling the power converters to obtain braking, or flow control, of the molten metal, as shown in the flowchart in FIG. 7.

Figure 4:
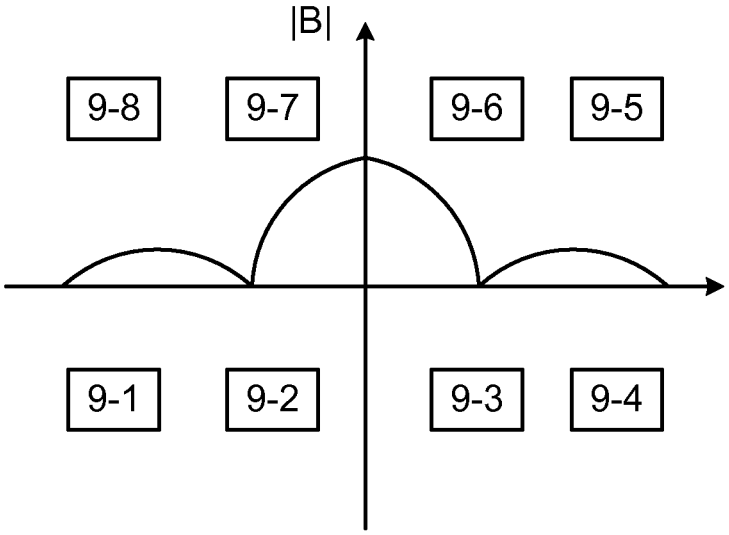
FIG. 4 shows an example of a static magnetic field distribution.
Figure 5:
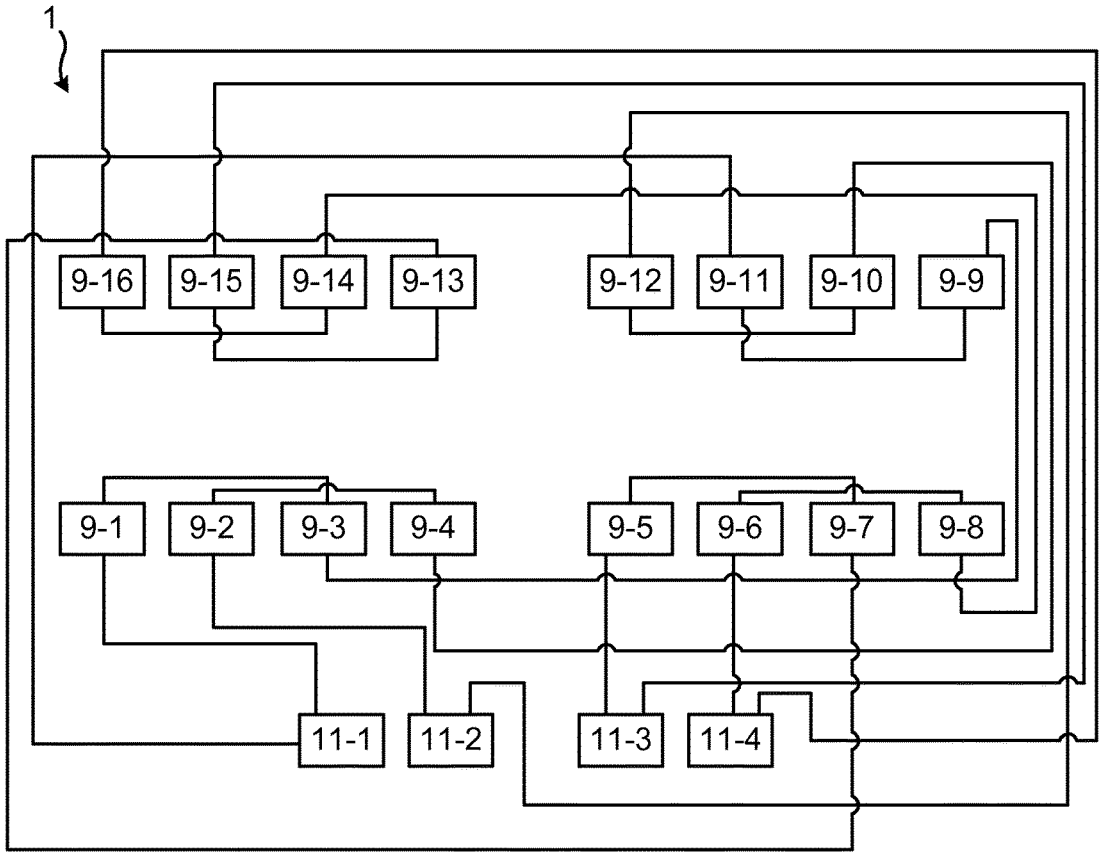
FIGS. 5-6 show two additional examples of connections between coils and power converters of an electromagnetic brake system.
Figure 6:
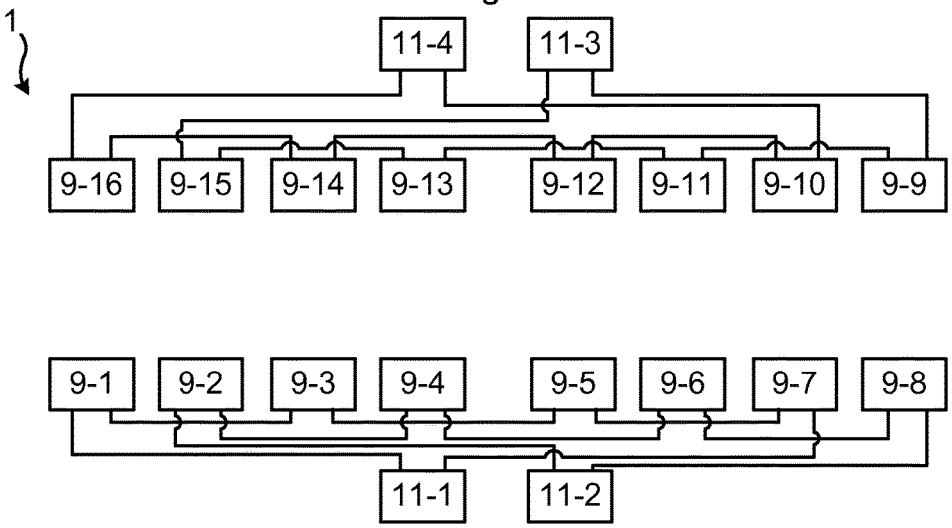

As previously mentioned, the coils 9 are arranged in groups of coils. All the coils in each group of coils are series-connected. Each group of coils comprises $2N_c/N_p$ series-connected coils 9. This is not shown in FIG. 2; examples are shown in FIGS. 4-6, and will be described with reference to these figures. Each group of coils is further connected to a respective power converter 11-1, . . . , 11-$N_p$. Each power converter is arranged to feed a DC current to a respective group of coils of the first set of coils.

At least two coils of each group of coils are wound around teeth of either the first long side or the second long side of the first magnetic core arrangement. Between any of two subsequently arranged coils of a group of coils, along either the first long side or the second long side, is a coil of another group of coils. The coils of the groups of coils are hence arranged in an alternating manner.

According to one variation, each of the $N_p$ power converters is configured to provide an AC current to its respective group of $2N_c/N_p$ series-connected coils to thereby enable electromagnetic stirring of molten metal in a mould. This AC current may either be provided on its own, or superimposed onto the DC current. Thus, in addition to braking, electromagnetic stirring by means of a traveling magnetic field, or a combination of stirring and braking may thereby be provided.

There are a number of ways to connect the coils 9-1, . . . , 9-2N, to the power converters 11-1, . . . , 11-$N_p$. In the following, a number of methods of connecting the coils 9-1, . . . , 9-2$N_c$ to power converters 11-1, . . . , 11-$N_p$ will be described. For this purpose, the following nomenclature will be utilised.

Np=Number of power converters;

Nc=Number of coils per side.

Furthermore, in the description of these methods both the first long side 7*a* and the second long side 7*b* are numbered from 1 to $N_c$.

For 2-3 power converters:

A.

According to variation A of the method, power converter k is connected to coil (side L of the mould, i.e. the second long side in FIG. 2): k+Np*(i_L−1), i_L=1, 2, . . . , Nc/Np and to coil (side F of the mould, i.e. the first long side in FIG. 2): k+Np*(i_F−1), i_F=1, 2, . . . , Nc/Np For More than 3 Power converters there are several configuration alternatives, namely A, B, C and D:

B.

According to variation B, power converter k is connected to coil (side L of the mould): k+Np/2*(i_L−1), i_L=1, 2, . . . , Nc/(Np/2)

and to coil (side F of the mould): k+Np/2*(i_F−1), i_F=1, 2, . . . , Nc/(Np/2)

if k≤Np/2 and Nc/2 is even.

Power converter k is connected to coil (side L of the mould): Nc/2+(k−Np/2)+Np/2*(i_L−1), i_L=1, 2, . . . , Nc/(Np/2)

and to coil (side F of the mould): Nc/2+(k−Np/2)+Np/2*(i_F−1), i_F=1, 2, . . . , Nc/(Np/2)

if k>Np/2 and Nc/2 is even.

Power converter k is connected to coil (side L of the mould): k+Np/2*(i_L−1), i_L=1, 2, . . . , (Nc+2)/(Np/2)

and to coil (side F of the mould): k+Np/2*(i_F−1), i_F=1, 2, . . . , (Nc−2)/(Np/2)

if k is odd and ≤Np/2 and Nc/2 is odd.

Power converter k is connected to coil (side L of the mould): Nc/2+(k−Np/2)+Np/2*(i_L−1), i_L=1, 2, . . . , (Nc+2)/(Np/2)

and to coil (side F of the mould): Nc/2+(k−Np/2)+Np/2*(i_F−1), i_F=1, 2, . . . , (Nc−2)/(Np/2)

if k is odd and >Np/2 and Nc/2 is odd.

Power converter k is connected to coil (side L of the mould): k+Np/2*(i_L−1), i_L=1, 2, . . . , (Nc−2)/(Np/2)

and to coil (side F of the mould): k+Np/2*(i_F−1), i_F=1, 2, . . . , (Nc+2)/Np/2 if k is even and ≤Np/2 and Nc/2 is odd.

Power converter k is connected to coil (side L of the mould): Nc/2+(k−Np/2)+Np/2*(i_L−1), i_L=1, 2, . . . , (Nc−2)/(Np/2)

and to coil (side F of the mould): Nc/2+(k−Np/2)+Np/2*(i_F−1), i_F=1, 2, . . . , (Nc+2)/(Np/2)

if k is even and >Np/2 and Nc/2 is odd.

C.

According to variation C, power converter k is connected to coil (side L of the mould): k+Np/2*(i_L−1), i_L=1, 2, . . . , Nc/(Np/2)

and to coil (side F of the mould): Nc/2+(k−Np/2)+Np/2*(i_F−1), i_F=1, 2, . . . , Nc/(Np/2)

if k≤Np/2 and Nc/2 is even.

Power converter k is connected to coil (side L of the mould): Nc/2+k+Np*(i_L−1), i_L=1, 2, . . . , Nc/(Np/2)

and to coil (side F of the mould): k+Np*(i_F−1), i_F=1, 2, . . . , Nc/(Np/2)

if k>Np/2 and Nc/2 is even.

Power converter k is connected to coil (side L of the mould): k+Np/2*(i_L−1), i_L=1, 2, . . . , (Nc+2)/(Np/2)

and to coil (side F of the mould): Nc/2+(k−Np/2)+Np/2*(i_F−1), i_F=1, 2, . . . , (Nc−2)/(Np/2)

if k is odd and ≤Np/2 and Nc/2 is odd.

Power converter k is connected to coil (side L of the mould): Nc/2+k+Np*(i_L−1), i_L=1, 2, . . . , (Nc+2)/(Np/2)

and to coil (side F of the mould): k+Np*(i_F−1), i_F=1, 2, . . . , (Nc−2)/(Np/2)

if k is odd >Np/2 and Nc/2 is odd.

Power converter k is connected to coil (side L of the mould): k+Np/2*(i_L−1), i_L=1, 2, . . . , (Nc−2)/(Np/2)

and to coil (side F of the mould): Nc/2+(k−Np/2)+Np/2*(i_F−1), i_F=1, 2, . . . , (Nc+2)/(Np/2)

if k is even and ≤Np/2 and Nc/2 is odd.

Power converter k is connected to coil (side L of the mould): Nc/2+k+Np*(i_L−1), i_L=1, 2, . . . , (Nc−2)/(Np/2)

and to coil (side F of the mould): k+Np*(i_F−1), i_F=1, 2, . . . , (Nc+2)/(Np/2)

if k is even >Np/2 and Nc/2 is odd.

D.

According to variation D, power converter k is connected to coil (side L of the mould): k+Np/2*(i_L−1), i_L=1, 2, . . . , (Nc/Np)*2 if k≤Np/2.

Power converter k is connected to coil (side F of the mould): (k−Np/2)+Np/2*(i_F−1), i_F=1, 2, . . . , (Nc/Np)*2 if k>Np/2.

Figure 3:
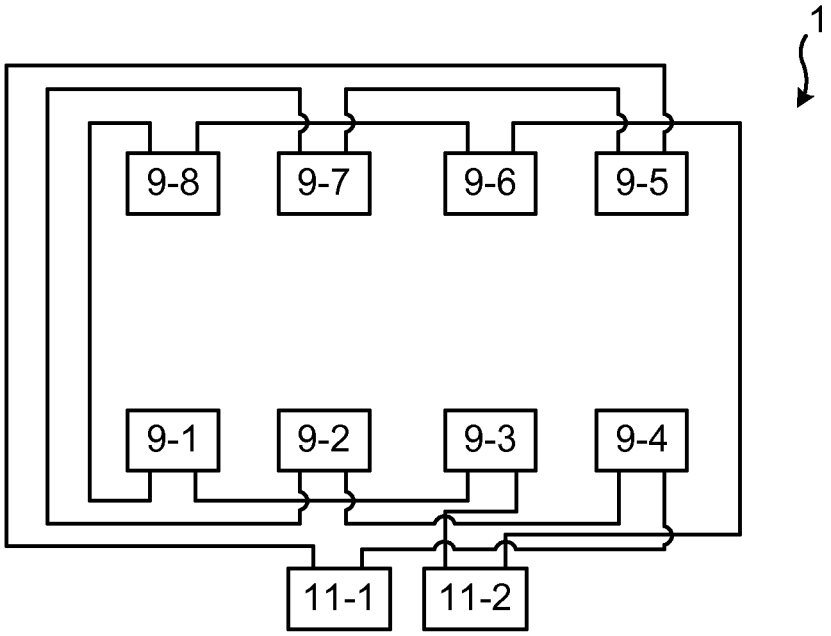
FIG. 3 shows a first example of connections between coils and power converters of an electromagnetic brake system.

FIG. 3 shows a first example of an electromagnetic brake system 1 with connections between the coils and the power converters, in particular the first set of coils arranged around the teeth of the first magnetic core arrangement. According to the example depicted in FIG. 3, the electromagnetic brake system 1 comprises two power converters 11-1 and 11-2 and the first set of coils comprises eight coils 9-1 to 9-8, four arranged around teeth of the first long side and four are arranged around teeth of the second long side. The first magnetic core arrangement is not shown for reasons of clarity.

The coils 9-1 to 9-8 and power converters 11-1 and 11-2 are connected according to the method of variation A. In the example, coils 9-1, 9-3, 9-6 and 9-8 are series-connected and thus form a group of coils. Coils 9-1, 9-3, 9-6 and 9-8 are connected to power converter 11-2. Furthermore, coils 9-2, 9-4, 9-5 and 9-7 are series-connected and thus form another group of coils. Coils 9-2, 9-4, 9-5 and 9-7 are connected to power converter 11-1. This particular example comprises 8 coils 9-1 to 9-8 and two power converters 11-1 and **11-*b***, resulting in 8/2=4 series-connected coils in each group of coils, and thus in two groups of series-connected coils.

By means of the above configuration, a homogeneous or an inhomogeneous static magnetic field distribution may be obtained along the width of the first long side **7*a* and the second long side 7*b*, and thus along the long side of a mould to which the electromagnetic brake system 1** is mounted. The static magnetic field distribution is in particular obtainable by controlling the power converters, namely by controlling the polarity and amplitude of the DC current provided by the power converters.

FIG. 4 shows an example of a static magnetic field distribution of the absolute value |B| of a magnetic field B along the first long side and the second long side. It can be seen that inhomogeneous static magnetic field distributions are obtainable.

FIG. 5 shows a second example of an electromagnetic brake system 1, with connections between the coils and the power converters, in particular the first set of coils arranged around the teeth of the first magnetic core arrangement. According to the example depicted in FIG. 5, the electromagnetic brake system 1 comprises sixteen coils 9-1 to 9-16 and four power converters 11-1 to 11-4. Eight of the coils are arranged around teeth of the first long side and eight coils are arranged around teeth of the second long side. Again, the first magnetic core arrangement is not shown in FIG. 5 for reasons of clarity.

The coils 9-1 to 9-16 and power converters 11-1 to 11-4 are connected by means of the method of variation B. In the example, coils 9-1, 9-3, 9-9 and 9-11 are series-connected and thus form a group of coils. Coils 9-1, 9-3, 9-9 and 9-11 are connected to power converter 11-1. Furthermore, coils 9-2, 9-4, 9-10 and 9-12 are series-connected and thus form another group of coils. Coils 9-2, 9-4, 9-10 and 9-12 are connected to power converter 11-2. Coils 9-5, 9-7, 9-13, 9-15 are series-connected and form yet another group of coils. Coils 9-5, 9-7, 9-13, 9-15 are connected to power converter 11-3. Finally, coils 9-6, 9-8, 9-14, 9-16 are series-connected form a fourth group of coils. Coils 9-6, 9-8, 9-14, 9-16 are connected to power converter 11-4. Thus, four groups of coils are obtained, each being individually controllable by a respective power converter 11-1 to 11-4.

The second example comprises sixteen coils 9-1 to 9-16 and four power converters 11-1 to 11-4, resulting in 16/4=4 series-connected coils in each group of coils, and thus in four groups of series-connected coils.

FIG. 6 shows a third example of an electromagnetic brake system 1, with connections between the coils and the power converters, in particular the first set of coils arranged around the teeth of the first magnetic core arrangement. According to the example depicted in FIG. 6, the electromagnetic brake system 1 comprises sixteen coils 9-1 to 9-16 and four power converters 11-1 to 11-4. Eight of the coils are arranged around teeth of the first long side and eight coils are arranged around teeth of the second long side. Again, the first magnetic core arrangement is not shown in FIG. 6 for reasons of clarity.

The coils 9-1 to 9-16 and power converters 11-1 to 11-4 are connected by means of the method of variation D. In the example, coils 9-1, 9-3, 9-5 and 9-7 are series-connected and thus form a group of coils. Coils 9-1, 9-3, 9-5 and 9-7 are connected to power converter 11-1. Furthermore, coils 9-2, 9-4, 9-6 and 9-8 are series-connected and thus form another group of coils. Coils 9-2, 9-4, 9-6 and 9-8 are connected to power converter 11-2. Coils 9-9, 9-11, 9-13, 9-15 are series-connected and form yet another group of coils. Coils 9-9, 9-11, 9-13, 9-15 are connected to power converter 11-3. Finally, coils 9-10, 9-12, 9-14, 9-16 are series-connected form a fourth group of coils. Coils 9-10, 9-12, 9-14, 9-16 are connected to power converter 11-4. Thus, four groups of coils are obtained, each being individually controllable by a respective power converter 11-1 to 11-4.

The third example comprises sixteen coils 9-1 to 9-16 and four power converters 11-1 to 11-4, resulting in 16/4=4 series-connected coils in each group of coils, and thus in four groups of series-connected coils.

Furthermore, according to the third example, each power converter 11-1 to 11-4 is only connected to coils along one of the first long side and the second long side.

Figure 8:
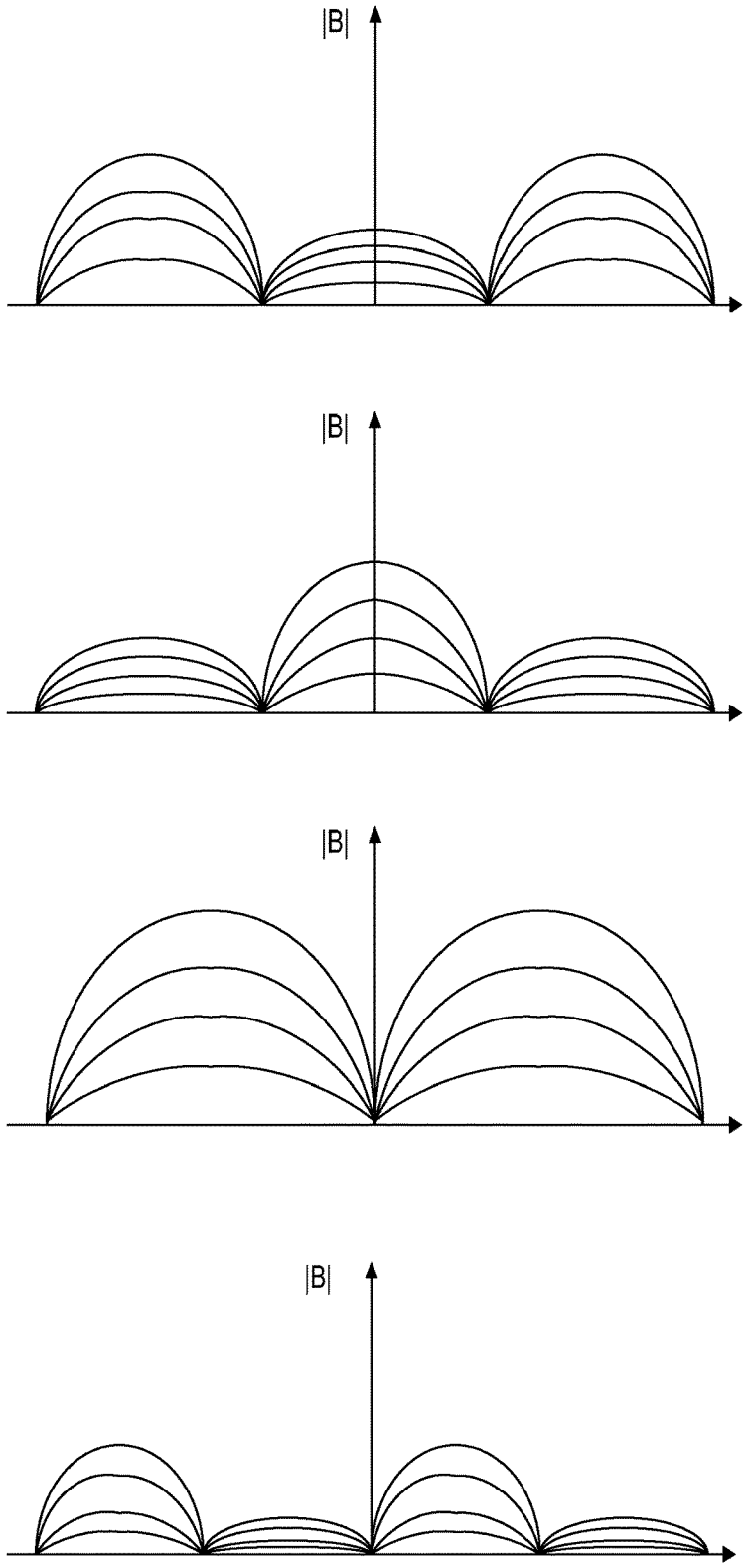
FIG. 8 shows various static magnetic field distributions obtainable by means of an electromagnetic brake system.

FIG. 8 shows different examples of asymmetric and symmetric inhomogeneous static magnetic field distributions along the length of the first long side and the second long side of the first magnetic core arrangement 7. This static magnetic field distribution may hence be obtained in molten metal, in the proximity of the meniscus, when the electromagnetic brake system 1 is mounted to an upper portion of a mould.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. An electromagnetic brake system for a metal-making process, wherein the electromagnetic brake system comprises:

a first magnetic core arrangement having a first long side and a second long side, which first long side has $N_c$ teeth and which second long side has $N_c$ teeth, wherein the first long side and the second long side are arranged to be mounted to opposite longitudinal sides of an upper portion of a mould, a first set of coils, wherein the first set of coils comprises $2N_c$ coils, each coil being wound around a respective tooth of the first magnetic core arrangement, and $N_p$ power converters, with $N_p$ being an integer that is at least two and $N_c$ is an integer that is at least four and evenly divisible with $N_p$, wherein each power converter is connected to a respective group of $2N_c/N_p$ series-connected coils of the first set of coils, and wherein each of the $2N_C$ coils receives DC current from its respective power converter, and wherein at least two coils of each group are wound around teeth of the first long side of the first magnetic core arrangement and at least two coils of each group are wound around teeth of the second long side of the first magnetic core arrangement.

2. The electromagnetic brake system as claimed in claim 1, wherein each power converter is individually controllable thereby enabling a controllable homogeneous or inhomogeneous magnetic field distribution along the first long side and the second long side of the first magnetic core arrangement.

3. The electromagnetic brake system as claimed in claim 1, wherein between any of two subsequently arranged coils of a group of coils, along either the first long side or the second long side, is a coil of another group of coils.

4. The electromagnetic brake system as claimed in claim 1, wherein each power converter is a drive.

5. The electromagnetic brake system as claimed in claim 1, comprising:

a second magnetic core arrangement having a first long side and a second long side, which first long side and the second long side comprises a plurality of teeth, and a second set of coils, each coil of the second set of coils being wound around a respective tooth, wherein the first long side and the second long side are arranged to be mounted to opposite longitudinal sides of a lower portion of the mould.

6. The electromagnetic brake system as claimed in claim 5, comprising a power converter configured to provide DC current to the second set of coils.

7. A method of controlling molten metal flow in a metal-making process, by means of an electromagnetic brake system comprising a first magnetic core arrangement having a first long side and a second long side, the first long side has $N_c$ teeth and the second long side has $N_c$ teeth, wherein the first long side and the second long side are mounted to opposite longitudinal sides of an upper portion of a mould, in level with a submerged entry nozzle, SEN, a first set of coils, wherein the first set of coils comprises $2N_c$ coils, each coil being wound around a respective tooth of the first magnetic core arrangement, and $N_p$ power converters, with $N_p$ being an integer that is at least two and $N_c$ is an integer that is at least four and evenly divisible with $N_p$, wherein each power converter is connected to a respective group of $2N_c/N_p$ series-connected coils of the first set of coils, and wherein each of the $2N_C$ coils receives DC current from its respective power converter, wherein the method comprises controlling the $N_p$ power converters to obtain braking of the molten metal in the upper portion of the mould and wherein at least two coils of each group are wound around teeth of the first long side of the first magnetic core arrangement and at least two coils of each group are wound around teeth of the second long side of the first magnetic core arrangement.

8. The method as claimed in claim 7, comprising controlling each power converter individually to obtain either a homogeneous or an inhomogeneous magnetic field distribution along the first long side and the second long side of the first magnetic core arrangement.

9. The method as claimed in claim 7, wherein between any of two subsequently arranged coils of a group of coils, along either the first long side or the second long side, is a coil of another group of coils.

10. The method as claimed in claim 7, wherein each power converter is a drive.

11. The method as claimed in claim 7, wherein the electromagnetic brake comprises a second magnetic core arrangement having a first long side and a second long side, which first long side and the second long side comprises a plurality of teeth, and a second set of coils, each coil of the second set of coils being wound around a respective tooth, wherein the first long side and the second long side are arranged to be mounted to opposite longitudinal sides of a lower portion of the mould.

12. The method as claimed in claim 11, comprising a power converter configured to provide DC current to the second set of coils, wherein the method further comprises controlling the power converter.

13. The method as claimed in claim 8, wherein each power converter is a drive.

14. An electromagnetic brake system for a metal-making process, wherein the electromagnetic brake system comprises:

a first magnetic core arrangement having a first long side and a second long side, which first long side has $N_c$ teeth and which second long side has $N_c$ teeth, wherein the first long side and the second long side are arranged to be mounted to opposite longitudinal sides of an upper portion of a mould, a first set of coils, wherein the first set of coils comprises $2N_c$ coils, each coil being wound around a respective tooth of the first magnetic core arrangement, $N_p$ DC power converters, with $N_p$ being an integer that is at least two and $N_c$ is an integer that is at least four and evenly divisible with $N_p$, wherein each power converter is connected to a respective group of $2N_c/N_p$ series-connected coils of the first set of coils, wherein each of the $2N_C$ coils receives only DC current from their respective power converter, wherein at least two coils of each group are wound around teeth of the first long side of the first magnetic core arrangement and at least two coils of each group are wound around teeth of the second long side of the first magnetic core arrangement; and wherein each DC power converter has an individually selected amplitude and polarity of DC current sent to its respective group of coils.

* * * * *